United States Patent [19]

Stith

[11] Patent Number: 4,862,644

[45] Date of Patent: Sep. 5, 1989

[54] OPTICAL LAPPING MACHINE

[76] Inventor: Joe D. Stith, Rte. 5, Box 596, Muskogee, Okla. 74401

[21] Appl. No.: 292,820

[22] Filed: Jan. 3, 1989

[51] Int. Cl.[4] ..... B24B 7/00

[52] U.S. Cl. ..... 51/58; 51/216 LP; 51/33 R

[58] Field of Search ..... 51/33 R, 58, 60, 216 LP, 51/217 L, 284 R, 64, 65, 68, 124 L; 65/37, 39, 61, 102; 350/417

[56] References Cited

U.S. PATENT DOCUMENTS

| | | | |
|---|---|---|---|
| 3,595,108 | 7/1971 | Priscsak | 82/18 |
| 3,732,647 | 5/1973 | Stith | 51/124 L X |
| 3,842,713 | 10/1974 | Hamilton et al. | 409/132 |
| 3,916,574 | 11/1975 | Prunier | 51/124 L |
| 4,143,490 | 3/1979 | Wood | 51/58 |
| 4,232,485 | 11/1980 | Eadon-Allen | 51/124 L X |
| 4,257,194 | 3/1981 | Cailloux | 51/124 L X |
| 4,320,599 | 3/1982 | Hill et al. | 51/58 |
| 4,733,649 | 3/1988 | Regler et al. | 51/65 X |
| 4,798,024 | 1/1989 | Grimm | 51/58 X |

FOREIGN PATENT DOCUMENTS

| | | | |
|---|---|---|---|
| 0242999 | 2/1987 | Fed. Rep. of Germany | 51/216 LP |
| 0595073 | 2/1978 | U.S.S.R. | 82/18 |
| 1564398 | 4/1980 | United Kingdom | 51/283 R |

*Primary Examiner*—Roscoe V. Parker
*Assistant Examiner*—Shirish Desai
*Attorney, Agent, or Firm*—Head & Johnson

[57] ABSTRACT

A machine for finishing the surface of a lens mounted on one side of a lens block having receiving depressions in its other side, the machine having a cylindrical tube mounted for rotary and reciprocal motion on a fixed shaft, an optical tool holder affixed to one end of the cylindrical tube and adapted to receive an optical lap thereon, an arm having pins extending therefrom to engage the pin recesses in a lens block having a lens mounting thereon for holding the lens in contact with the optical lap, a coupling block affixed to the cylindrical tube adjacent the other end thereof and having a spherical plane bearing therein, an outer cylindrical drive member having an eccentric longitudinal opening therethrough, an inner cylindrical drive member also having an eccentric cylindrical opening therethrough, the inner cylindrical drive member being rotatably received in the opening through the outer cylindrical member, the cylindrical drive members being independently related, a shaft extending through the longitudinal opening in the second cylindrical drive member having indexing means so that the position of the shaft relative to the second drive member may be fixed, but when fixed, the shaft rotates with the second cylindrical drive member and an eccentric connector at one end of the shaft having a secondary drive shaft engaging the spherical drive bearing so that as the outer and inner cylindrical drive shafts are rotated, rotational and reciprocal motion is applied to the cylindrical tube.

10 Claims, 4 Drawing Sheets

OPTICAL LAPPING MACHINE

SUMMARY OF THE INVENTION

The present invention relates to a machine for polishing an ophthalmic lens. Polishing includes fining, that is, to form a lens to its final surface for use by a wearer.

The machine of this invention relates to a type of polisher used to finish cylindrical lens in which the lap surface must be held in engagement with the lens surface and moved relative thereto in a path which is non-repetitious; that is, which will prevent the formation of ridges, grooves and other aberrations in the lens surface which occur when regular or uniform less grinding motion is utilized.

The use of machines for lens grinding is a very well-known technology and for background information relating to the area of art to which the present invention pertains, reference may be had to the following U.S. Pat. Nos.: 3,732,647; 3,552,899 and 4,534,137. Generally speaking, a lens is ground, or at least the final polishing or fining step is conducted by rotating a lens secured to a lens blocking against an optical lap. The optical lap has a surface configuration having the desired ultimate shape of the surface of the lens being ground. The lens is normally secured to a block such as by an adhesive and the block typically has spaced apart pin receiving recesses in the rearward side thereof.

The machine of this disclosure employs an axially and rotationally actuated cylindrical tube with a coupling block affixed to the cylindrical tube adjacent to the lower end thereof. A spherical plane bearing is received within the recess within a coupling block.

An outer cylindrical drive member is rotatable by bearings in a housing with the rotational axis of the cylindrical drive member intersecting the vertical axis of the cylindrical tube. This outer cylindrical drive member has a longitudinal opening therethrough, the axis of which is eccentric to the outer cylindrical drive member cylindrical axis. Rotatably received within such eccentric opening in the outer cylindrical drive member is an inner cylindrical drive member. The inner cylindrical drive member in turn has a longitudinal opening therethrough which is eccentric to the inner cylindrical drive member cylindrical axis.

Rotatably received within the opening of the cylindrical drive member is a primary drive shaft.

A sheave is received on the outer cylindrical drive member and the sheave receives a belt by which the outer cylindrical drive member is rotated. In like manner, a sheave is received on the inner cylindrical drive member which in turn receives a belt so that thereby both cylindrical drive members can be rotated and at speeds independent of each other.

A series of openings are provided on the sheave affixed to the inner cylindrical member. By means of a displaceable stake knob secured to rotate with the primary drive shaft, the angular position of the primary drive shaft with respect to the inner cylindrical drive member can be adjusted.

Extending from the end of the primary drive shaft is a secondary drive shaft having an axis which is parallel and eccentric to the axis of the primary drive shaft. The secondary drive shaft is received by the spherical plane bearing in the coupling block. It can thereby be seen that by rotating the inner cylindrical drive shaft which in turn rotates the primary drive shaft and thereby the secondary drive shaft that a rotational and reciprocal motion is applied to the cylindrical tube. The applicability of this motion is selected by the rotational position of the primary drive shaft relative to the inner cylindrical drive member. Further, it can be seen that by rotation of the outer cylindrical member, which is made to rotate at a slower RPM, that the rotary and longitudinal displacement of the cylindrical tube is compounded.

The motion of the cylindrical tube is transmitted directly to the optical tool holder and thereby to the optical lap and this combination rotary and linear motion is thereby applied to the surface of the lens being ground.

A grinding compound is applied between the optical lap and the lens.

The disclosure includes the use of a pneumatic system for clamping the optical laps to the optical tool holder and for moving the arm which engages the lens block into and out of position so that a user can, such as by means of a foot actuated pneumatic switch, have both hands free to simultaneously mount optical laps and blocks with lenses affixed thereto to opposite ends of the optical tool holder so that two lenses can be ground simultaneously.

The machine for finishing the surface of a lens as provided herein achieves a compound oscillatory grinding motion in a simplified arrangement, one which is easy to use by an operator.

A better understanding of the invention will be had by reference to the following description of the preferred embodiment and the claims, taken in conjunction with the attached drawing.

DESCRIPTION OF THE PREFERRED EMBODIMENT

Figures 1, 6:
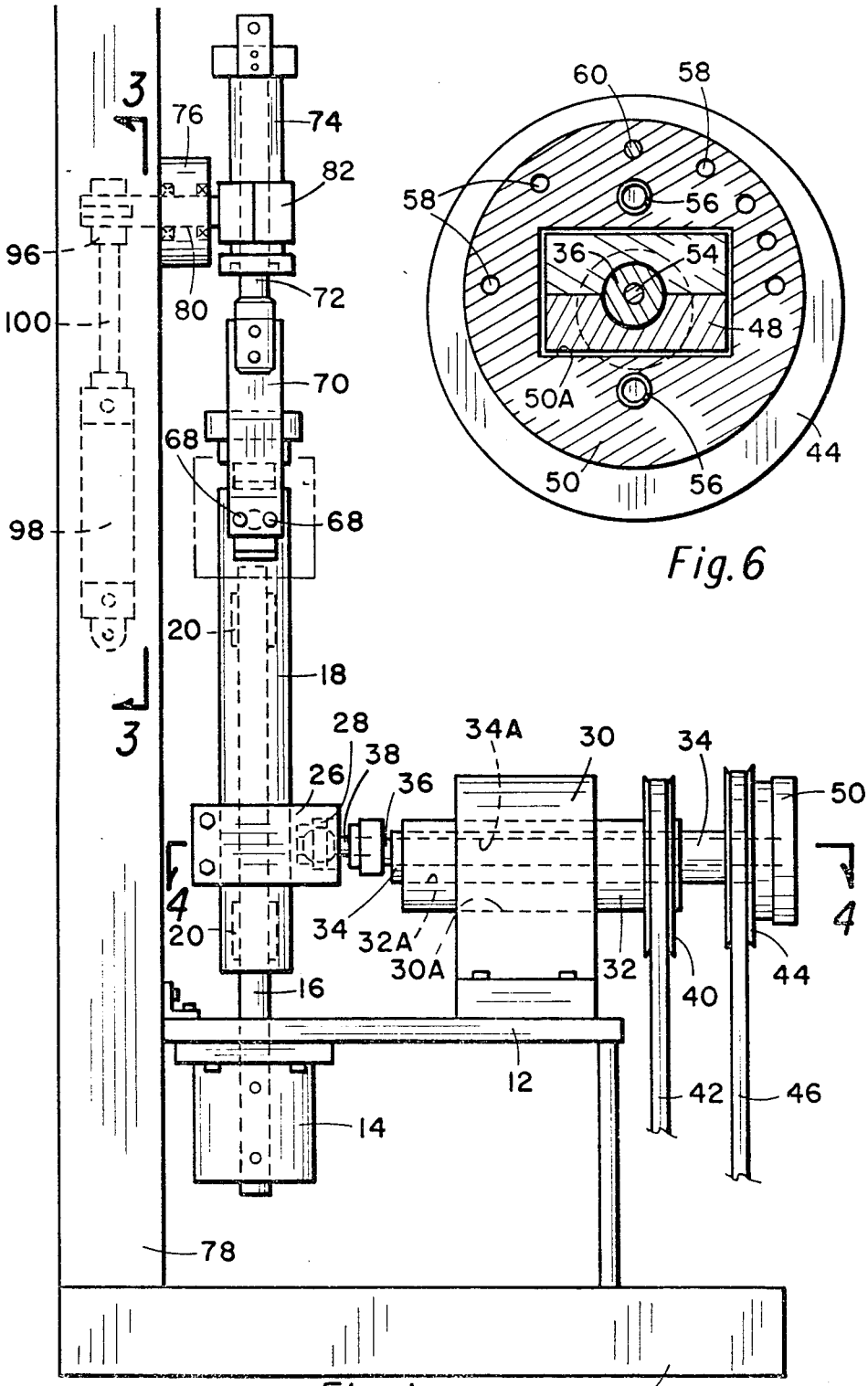
FIG. 1 is an elevational side view of an embodiment of the invention.
FIG. 6 is a cross-sectional view taken along the line 6—6 of FIG. 4 and showing the system for indexing the rotational relationship between the primary drive shaft and the inner cylindrical drive member.
Figure 2:
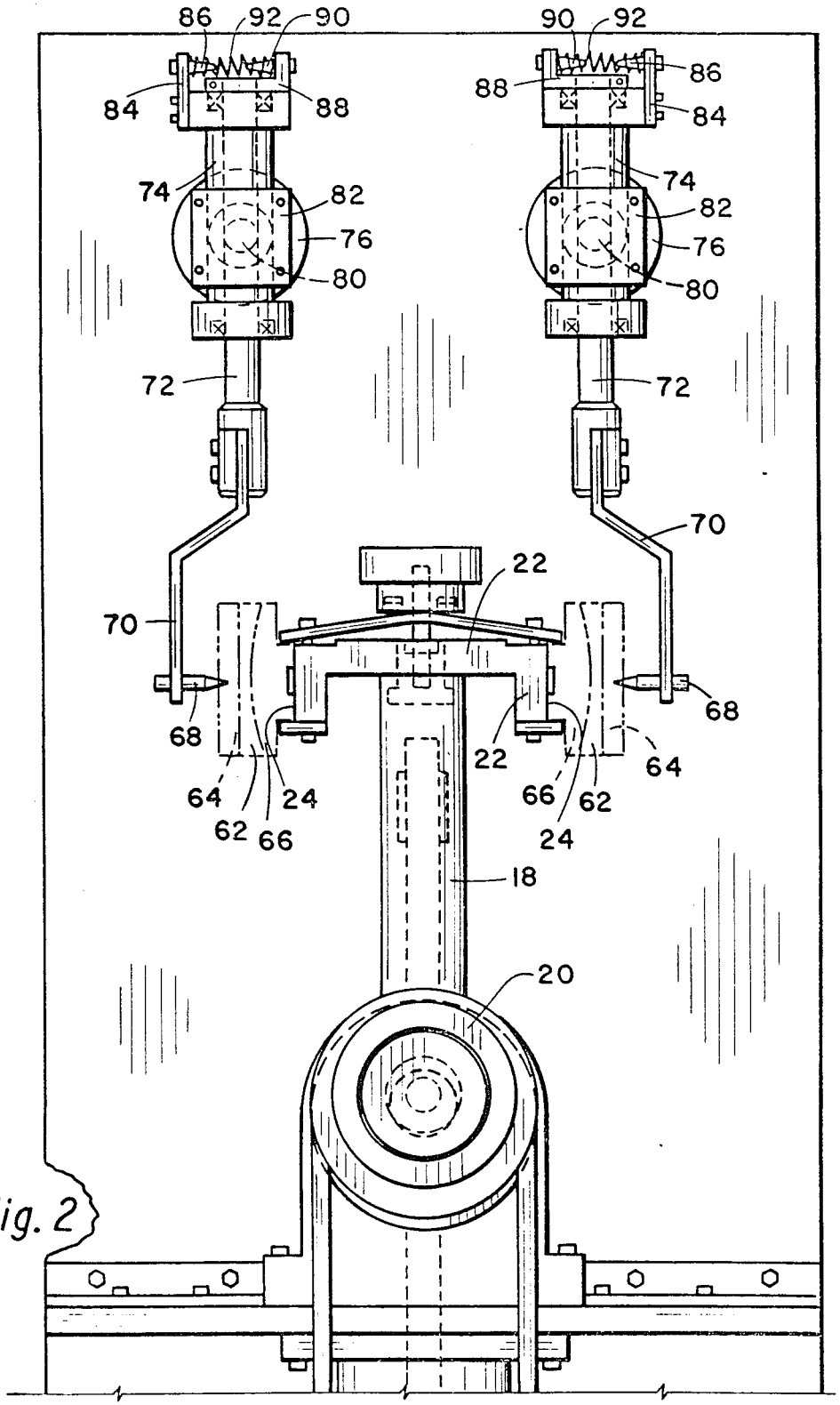
FIG. 2 is an elevational front view of the machine of FIG. 1.

Referring to the drawings and first to FIGS. 1 and 2, a base 10 supports a plate 12. Plate 12 has a shaft support 14 attached to the underneath side thereof, the shaft support having a cylindrical opening therethrough matching a cylindrical opening in plate 12. A shaft 16 is received in and supported by the shaft support 14, the shaft extending uprightly above the upper surface of plate 12.

A vertical cylindrical tube 18 is mounted on shaft 16 and is supported by the shaft for both rotational and reciprocal motion by the employment of bearings 20. Thus, the tube 18 is both longitudinal and reciprocal relative to shaft 16. Secured to the upper end of the cylindrical tube 18 is an optical tool holder 22 which has opposed paralleled lap table surfaces 24. The lap table surfaces are configured to accept optical lapping tools as will be described subsequently. The cylindrical tube 18 is illustrated and described as being vertical, it being understood that the machine functions in the same way whether the cylindrical tube is vertical or horizontal.

The main function of the mechanism of this invention is to provide a compound rotational and reciprocal motion to the cylindrical tube 18 to thereby transfer this motion of the optical tool holder 22. This motion is best understood with reference to FIGS. 1 and 4. Affixed adjacent the lower end of the cylindrical tube 18 is a coupling block 26. The coupling block 26 has a recess 26A therein which receives a spherical plane bearing 28 or other type of universal joint.

Secured on the top surface of support plate 12 is a drive housing 30 having a cylindrical opening 30A therethrough which rotatably receives an outer cylindrical drive member 32. This outer cylindrical drive member 32 rotates about a cylindrial axis within the drive housing 30. It has a longitudinal opening 32A therethrough, the axis of which is parallel to and displaced from the rotational axis of the outer cylindrical drive member 32.

Rotatably received in the eccentric opening 32A is an inner cylindrical drive member 34 which rotates about a cylindrical axis. In like manner, the inner cylindrical drive member 34 has a longitudinal opening 34A therethrough which has an axis parallel to and displaced from the rotational axis of the inner cylindrical drive member 34. Received in the eccentric opening 34A is primary drive shaft 36. While not shown, it is understood that bearings may be employed between the outer cylindrical drive member 32 and the drive housing 30 and between the inner cylindrical drive member 34 and the outer cylindrical drive member 32. Bearings between the primary drive shaft 36 and the inner cylindrical drive member 34 are not as important since these members rotate relative to each other only when indexing is being changed, as will be described subsequently.

Secured to the outer end of the primary drive shaft 36 is a secondary drive shaft 38. The axis of secondary drive shaft 38 is offset but parallel to the axis of primary drive shaft 36.

The secondary drive shaft 38 is received within the spherical bearing 28.

Received on the outer cylindrical drive member 32 is a sheave 40 which is driven by a belt 42. In like manner, received on the exterior of the inner cylindrical drive member 34 is a sheave 44 driven by belt 46.

Figure 4:
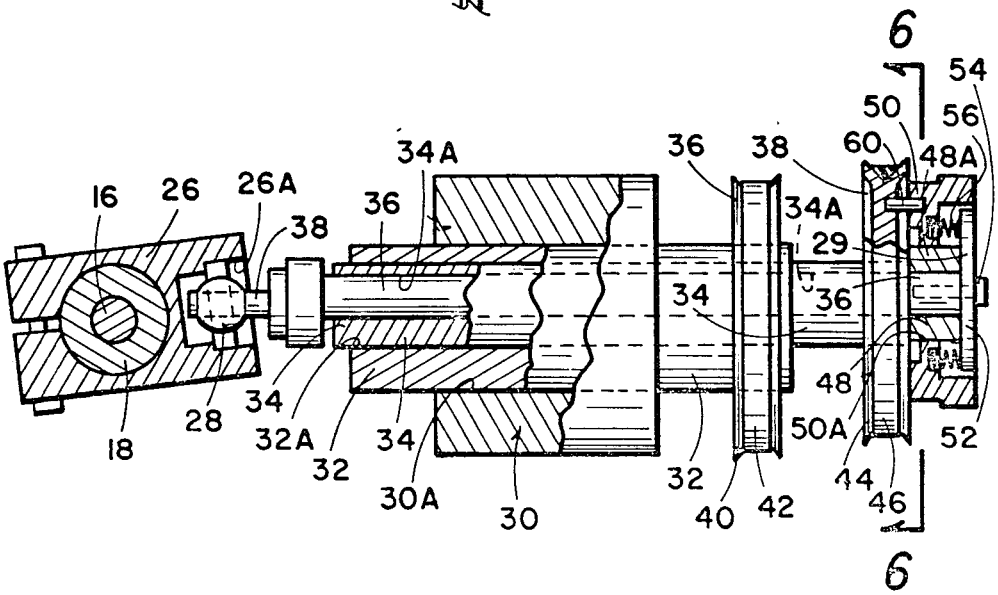
FIG. 4 is a cross-sectional view of the mechanism utilized to provide the compound oscillatory motion to the cylindrical tube and is taken along the lines 4—4 of FIG. 1.

As shown best in a cross-sectional view of FIG. 4, the primary drive shaft 36 has secured to it, at the portion extending beyond the inner cylindrical drive member 34 and sheave 44, a bushing 48. The busing 48 is secured in a non-rotatable manner relative to primary drive shaft 36, such as by a key (not shown). The external surface 48A is noncircular; that is, square, rectangular, hex, etc. Slideably received on the external surface 48A is a collar member 50 having an internal surface 50A which matches and slides on the bushing external surfaces 48A. Secured to the outer end of primary drive shaft 36 is a plate 52 held by bolt 54. Between the plate and the interior of the collar member 50 are springs 56 which urge the collar member 50 in the direction toward sheave 44.

As seen in FIG. 6, the sheave 44 has a plurality of small openings 58 which are equal spaced from the axis of the opening 34A in the inner cylindrical drive member 34. Affixed to collar member 50 is a pin 60 which is receivable within any one of the openings 58. It can be seen that an operator, by pulling on the collar member 50 can disengage pin 60 from an opening 58 and rotate the collar member and thereby the primary drive shaft 36 relative to the inner cylindrical drive member 34 to realign the pin with a different opening 58 at which time force on the collar member 50, may be released. Thus, the primary drive shaft 36 can be indexed relative to the inner cylindrical drive member 34.

Figure 5:
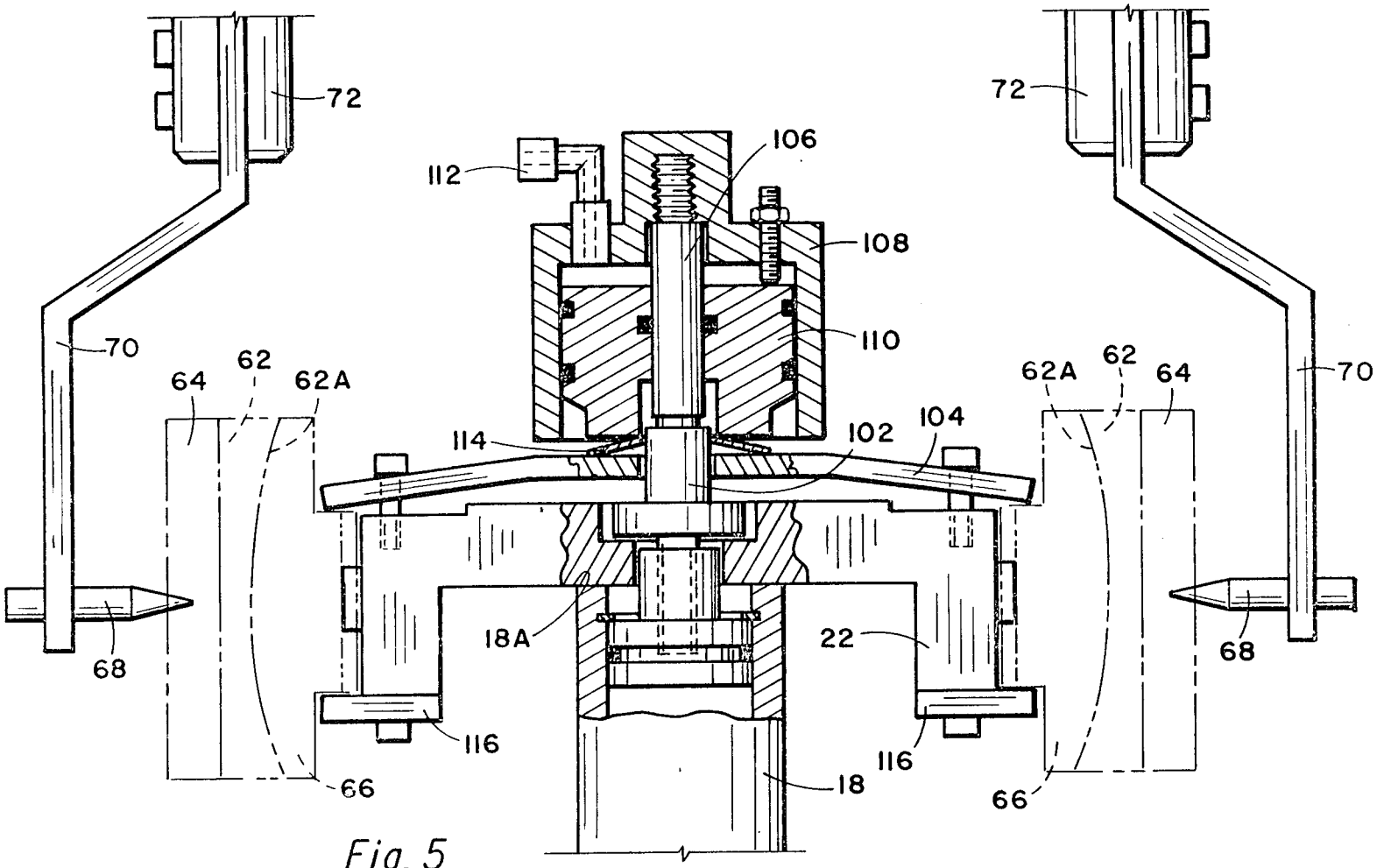
FIG. 5 is an elevational partial cross-sectional view, in enlarged scale, of the upper end of the cylinder tube and showing the optical tool holder, the jaws and the pneumatic means for clamping the optical lap members to each end of the optical tool holder.

It can be seen that as sheaves 40 and 44 are rotated a compound oscillatory motion is applied to secondary drive shaft 38 which in turn applies the motion through coupling block 26 to the cylindrical tube 18. This compound rotational and reciprocal motion is applied then to the optical tool holder 22. Referring to FIGS. 2 and 5, more details of the way this compound rotary and reciprocal motion is used to grind a lens will be better understood. Lenses 62 are shown in dotted outline and are typically secured at their rearward surfaces to a lens block 64 such as by means of an adhesive. The function of the machine is to grind the lens surface 62A. This is accomplished by contacting the lens surface 62A with the surface of an optical lap 66, also shown in dotted outline since such optical laps are standard items used in the trade. As illustrated in FIG. 5, each optical lap 66 has a surface which is that desired for the configuration of the lens surface 62A. A grinding compound is supplied between the surface of the optical lap 66 and the surace 62A of the lens.

Each lens block 64 has, in its rearward face, spaced apart recesses which receive pins 68. These pins are in the form of hair pins as seen in FIG. 1, so that the lens is held in prescribed orientation relative to the lens blocks 64.. Pins 68 are secured to arms 70 which are in turn affixed at their upper ends to shafts 72.

As seen in FIGS. 1 and 2, each shaft 72 is rotatably received in a housing 74, the shafts being supported for rotational but nonaxial displacement relative to the housings. The housings are supported by brackets 82 as shown in FIG. 1, the brackets being supported by a vertical support member 78 and by housing 76 and shaft 80 extending from base 10. Pivoted to the head support member 76 at each end thereof about shafts 80 are clamp portions 82 which are secured to the cylindrical housing 74. Affixed to the upper end of each housing 74 is a bracket 84 having a conical pin 86. Affixed to upper end of each shafts 72 is a bracket 88 having a conical pin 90. Extending between pins 86 and 90 is a coiled compression spring 92. The function of the brackets 84 and 88, the pins 86 and 90, and compression spring 92 is to ensure that when the arms 70 are pivoted into position to engage lens block 64 that the engaging pins 68 will be directly aligned and facing the lap table surfaces 24. At the same time, this arrangement allows free pivotation of the shafts 72 with respect to the housing 74.

Figure 3:
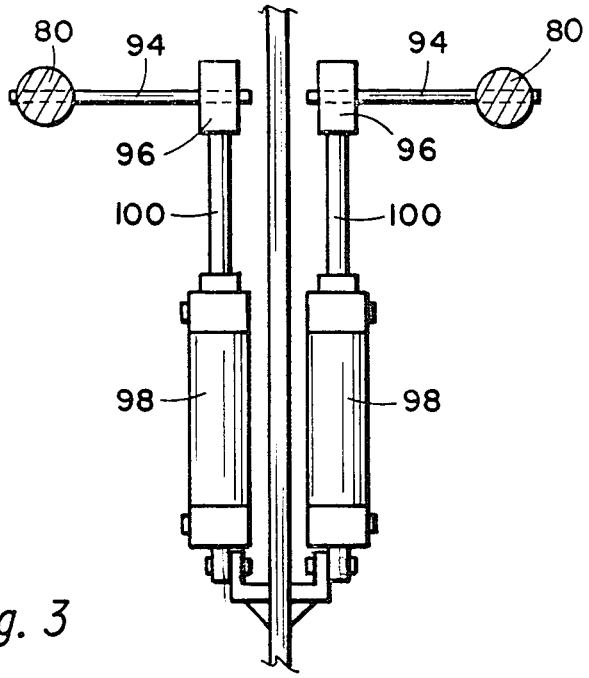
FIG. 3 is an elevational partial cross-sectional view taken along the line 3—3 of FIG. 1 and showing pneumatic cylinders as used for moving the arms into and out of position.

In order to maintain a proper contact pressure between the lens 62 and the optical lap 66, the use of pneumatic system may be employed as illustrated in FIGS. 1 and 3. Shaft 80 and clamp 83 each receive an arm 94 which has the outer end thereof secured to a coupling 96. Pneumatic cylinders 98 each having a cylinder rod 100 extending therefrom, the rods being connected to the coupling 96. It can be seen that by the application of air pressure such as by utilizing a foot valve (not shown) shaft 80 may be rotated so that in one mode the arms 70 are urged in a direction toward the optical tool holder 22, and in the opposite mode the arms are urged away from the tool holder so as to allow the removal of and replacement of the lens block 64 and optical lap 66 on each end of the optical tool holder.

Another important feature of the invention is the means of rapidly removing and replacing optical laps 66 and lens blocks 64 with attached lens 62. This is best understood with reference to FIG. 5. Extending from the upper end 18A of the cylindrical tube is a bolt member 102 which is configured to also hold the optical tool holder 22 in position on cylindrical tube 18. Slideably positioned on bolt 102 is a moveable jaw member 104. An upward extension 106 of the bolt member has attached to it a cylindrical housing 108. Received within the housing is a piston 110 which is actuated upon by air pressure supplied to the interior of the housing 108 through piping 112.

Positioned between the piston 110 and the moveable jaw 104 is a cupped or spring washer 114 which bears against the top of the moveable jaw 104.

Secured to the lower ends of the optical tool holder 22 are fixed jaws 116. It can be seen that the optical laps 66 are held in position between jaws 104 and 116. It can further be seen that by means of pneumatic pressure such as operated by a foot valve (not shown), the force on moveable jaw 104 can easily be varied. When pressure is removed, the operator can easily remove both of the optical laps 66 and replace them as required. When the new laps are in position, by another actuation of such pneumatic foot valve, pressure can be applied by downward force on piston 110 to retain the optical laps in position as long as such pneumatic pressure is utilized. It can be seen that in this way the pivotation of arms 70 and the actuation of moveable jaw 104 may be accomplished by the same foot operator pneumatic valve, so that the user will have both hands free to remove and replace the optical laps and lens blocks with their attached lenses.

The invention thus described provides a unique apparatus for generating compound rotary-reciprocal motion between an optical lap and a lens, and in a method where the machine is easy to use. Further, the type of motion applied to the optical laps 66 can be easily varied by varying the indexing between the primary drive shaft 36 and the inner cylindrical drive member 34 as previously described.

The claims and the specification describe the invention presented and the terms that are employed in the claims draw their meansing from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularlity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A machine for finishing the surface of a lens mounted on one side of a lens block having pin receiving depressions in its other side, comprising:

a cylindrical tube mounted for rotary and reciprocal motion on a fixed shaft;

an optical tool holder affixed on said cylindrical tube and adaptable to receive at least one optical lap thereon;

arm means having pin means extending therefrom adaptable to engage the pin receiving recesses in a lens block having a lens mounted thereon for holding the lens in contact with said optical lap;

a coupling block affixed to said cylindrical tube adjacent the other end thereof, the coupling block receiving a universal joint means therein;

an outer cylindrical drive member rotatably supported about an axis of rotating perpendicular to the cylindrical axis of said cylindrical tube, and having a longitudinal opening therethrough the axis of which is eccentric to the outer cylindrical drive member cylindrical axis;

an inner cylindrical drive member rotatably received in said longitudinal opening in said outer cylindrical drive member and having a longitudinal opening therethrough, the axis of which is eccentric to the inner cylindrical drive member cylindrical axis;

a primary drive shaft rotatably received in said longitudinal opening in said inner cylindrical drive member;

means of selectably angularly rotatably locking said primary drive shaft to said inner cylindrical drive member to accomplish different amplitudes of motion between said lens block and said optical lap;

a universal joint means secured to said cylindrical tube;

a secondary drive shaft affixed to and extending from one end of said primary drive shaft, the axis of which is eccentrically displaced from the axis of said primary drive shaft, the secondary drive shaft being received by said universal joint means.

means of rotating said outer cylindrical drive member; and means of rotating said inner cylindrical drive member whereby said primary and thereby said secondary drive shaft is eccentrically rotated, applying rotary and reciprocal motion to said cylindrical tube and thereby to said optical tool holder, the motion of said cylindrical tube being augmented by the eccentric displacement of said inner cylindrical drive member by the rotation of said outer cylindrical drive member.

2. A machine for finishing the surface of a lens according to claim 1 wherein said means of rotating said outer cylindrical drive member includes a first sheave means secured thereto receiving a driven belt.

3. A machine for finishing the surface of a lens according to claim 1 wherein said means of rotating said inner cylindrical drive member includes a second sheave means secured thereto receiving a driven belt.

4. A machine for finishing the surface of a lens according to claim 1 wherein said means of selectably angularly rotatably locking said primary drive shaft to said inner cylindrical drive member to accomplish different amplitudes of motion between said lens block and said optical lap includes:

a knob member secured to said primary drive shaft in a fixed rotatable but manually longitudinally displaceable manner, said second sheave means having a plurality of spaced apart openings therein displaced from said primary drive shaft center of rotation;

pin means extending from said knob member and being receivable in said openings in said second sheave means; and means resiliently biasing said knob member towards said second sheave means whereby said knob member may be manually displaced away from said second sheave means to permit said primary drive shaft to be rotated relative to said inner cylindrical drive member to permit said pin to be placed selectably in one of said plurality of openings in said second sheave means.

5. A machine for finishing the surface of a lens according to claim 1 wherein said optical tool holder has means of receiving a said optical lap member on opposite sides of said cylindrical tube.

6. A machine for finishing the surface of a lens according to claim 1 wherein said optical tool has lap tables in planes perpendicular to the axis of said cylindrical tube, and includes:

a lower jaw means affixed to said optical tool holder below each of said lap tables;

an upper jaw means extending avoe and across said optical tool holder and having end portions spaced opposite each of said lower jaw means; and pneumatic means of applying force against said upper jaw means and to selectably urge said upper jaws means toward said lower jaw whereby two of said optical lap members may be secured in engagement with said opposed lap tables and held by said upper and lower jaw means.

7. A machine for finishing the surface of a lens according to claim 1 wherein said arm means includes a cylindrical shaft portion rotatably received in a housing whereby said arm is free to rotate in response to the motion of said optical lap as the arm urges a lens affixed to said lens block into contact with said optical lap.

8. A machine for finishing the surface of a lens according to claim 7 including a first bracket affixed to said arm cylindrical shaft portion and a second bracket affixed to said housing and a pin means affixed to each of said brackets and extending towards each other and including a coiled spring compressibly received at opposed ends thereof by said pins whereby when force tending to rotate said arm cylindrical shaft is removed, such as when said arm is not in engagement with a said lens block, said spring causes said pins to align with each other to return said arm to a preselected position.

9. A machine for finishing the surface of a lens according to claim 1 including pneumatic means of selectably urging said arm in the direction towards said optical tool holder.

10. A machine for finishing the surface of a lens according to claim 6 including pneumatic means of selectably urging said arm in the direction towards said optical tool holder whereby a single controllable pneumatic source may be employed to simultaneously clamp said optical lap to the said lap table and move said arm towards said optical tool holder to urge a block and lens secured thereto into contact with said optical lap.

* * * * *